United States Patent [19]

Greenwood

[11] 4,051,572

[45] Oct. 4, 1977

[54] SCOURING MITTEN

[76] Inventor: Helen Greenwood, 64 Fanning Ave., Hampton Bays, N.Y. 11946

[21] Appl. No.: 715,878

[22] Filed: Aug. 19, 1976

[51] Int. Cl.[2] ..... A47K 7/02

[52] U.S. Cl. ..... 15/227; 2/159

[58] Field of Search ..... 15/227, 208, 209 R, 15/209 C, 225, 104.94; 2/158, 159, 161 R, 161 A, 167, DIG. 6

[56] References Cited

U.S. PATENT DOCUMENTS

| | | | |
|---|---|---|---|
| 1,387,728 | 8/1921 | Kramer | 15/227 X |
| 2,030,494 | 2/1936 | Bireley | 15/227 |
| 2,745,128 | 5/1956 | Zeaner | 15/227 |
| 3,094,704 | 6/1963 | Abilgoord | 2/167 |
| 3,151,333 | 10/1964 | Scholz | 2/167 X |
| 3,226,751 | 1/1966 | Lemelson | 15/209 C |
| 3,885,249 | 5/1975 | Brabander | 2/158 |

FOREIGN PATENT DOCUMENTS

| | | | |
|---|---|---|---|
| 1,514,101 | 1/1968 | France | 15/227 |
| 460,385 | 11/1950 | Italy | 15/227 |

OTHER PUBLICATIONS

"Stylish Golfers 38 -Golf World-P.N.R. No. 1037, 10/19/68.

*Primary Examiner*—Edward J. McCarthy
*Attorney, Agent, or Firm*—Robert A. Kelly

[57] ABSTRACT

A waterproof stretchable scouring mitten having a hand covering portion forming a pouch for completely enveloping the exterior surface of a human hand, the pouch having a separate first portion for enveloping a thumb and a second separate portion for enveloping the remainder of the exterior of the hand, the pouch being composed of a waterproof stretchable first layer and having a second layer of scouring material intimately bonded to the outer surface of the pouch means, the second portion of said pouch means having a stretchable opening collar to permit ingress and egress of a hand into and out of the pouch means; a stretchable tubular cuff means integrally connected to and extending from the collar of the pouch means adapted to fit snugly onto the wrist and at least a portion of the forearm of a wearer of the mitten; liquid diversion means connected to the tubular cuff means to divert the flow of liquids along the cuff means from said pouch away from the arm of the wearer of the mitten; gusset means linearly mounted on the cuff means; closure means mounted on the cuff means adapted to open and close the gusset means to facilitate donning and removal of the scouring mitten being in linear alignment with the thumb.

5 Claims, 3 Drawing Figures

SCOURING MITTEN

BACKGROUND OF THE INVENTION

The use of scouring pads and scouring mittens is old in the art. The various pads and mittens in the past have used an abrasive surface to provide scouring action when washing dishes and the like. However, when such prior art devices have been employed, the user's hands are wetted by the cleansing solution. Many people are highly allergic to the popular detergents and when they use the prior art devices with such detergents, their skin is severely damaged. To overcome this problem, such people usually resort to using a separate waterproof glove along with the scouring device. This is unsatisfactory both from a cost standpoint and also due to the fact that the intermediate waterproof glove causes the user to lose gripping control on the object being held and scoured, causing dish washers to drop and break the dishes. The prior art scouring mittens are usually a single pocket mitten which covers only the hand of the user and provides very poor gripping control. In scouring mittens which have both a separate thumb pocket interconnected with a separate pocket for the balance of the hand and fingers of wearers thereof, no provision has been made to protect the wearer from getting cleansing solution in the glove if the portion of the glove through which the hand is inserted is depressed below the surface of the water. Some prior art devices have attempted to cure this defect by the simple use of elastic expansion type closures, which inevitably lose their elasticity, overexpand and fit too loosely permitting the cleansing solution to enter inside the glove.

SUMMARY OF THE INVENTION

A waterproof stretchable scouring mitten comprising hand covering means having a first pouch for enveloping a thumb and a second pouch for enveloping the remainder of the hand having a generally planar configuration and extending along an axis and a wrist opening to provide means for insertion and removal of a hand, said first pouch opening into and extending radially from said axis in substantial planar alignment with said axis, said hand covering means being composed of a waterproof stretchable first layer and a second layer of scouring material intimately bonded to and covering the outer surface of said first layer; tubular shaped stretchable waterproof cuff means extending from and connected with the said wrist opening, said cuff means having waterproof gusset means along the linear axis of the cuff means located normal to the plane of the said first pouch means to facilitate ingress and egress of a hand into the mitten through the cuff; closure means affixed to said gusset means to bring at least a circumferential portion of said cuff means to a snug fitting relationship with a portion of the forearm of a wearer of the mitten; and, liquid flow diversion means circumferentially mounted on said cuff means to direct the flow of liquids towards said hand covering means.

DESCRIPTION OF THE PREFERRED EMBODIMENT

Figure 1:
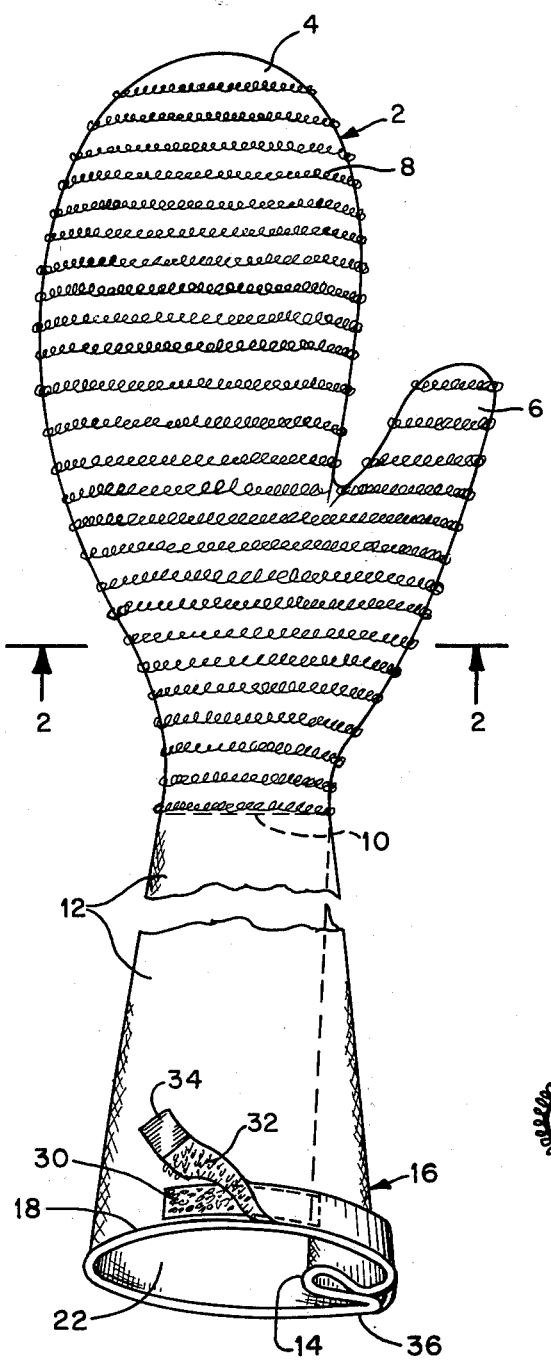
FIG. 1 is a semi-schematic perspective view of a preferred embodiment of the scouring mitten of my invention.
Figure 3:
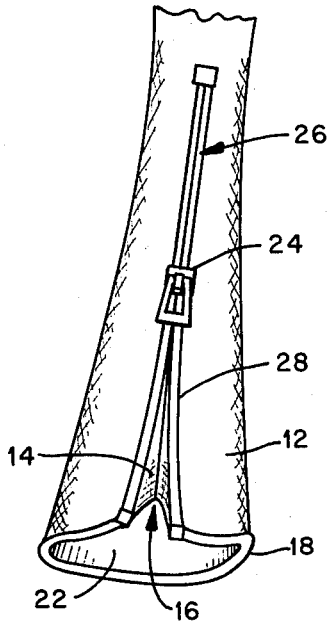
FIG. 3 is a partial side view of the mitten of FIG. 1 showing an alternative closure means.

FIG. 1 shows a scouring mitten 2 designed in accordance with my invention wherein a first pouch 6 for covering a thumb extends radially from a second pouch 4 which second pouch 4 is of a size and shape to cover the remaining portion of a wearer's hand. The entire outer surface of that portion including the pouches which are above broken line 10 is covered with scouring material 8.

The scouring mitten 2 has tubular waterproof cuff means 12 extending from the second pouch 4. Opening 22 on the cuff means 12 permits the user to insert a hand into the scouring mitten 2.

The scouring mitten 2 has an axis in longitudinal alignment with the tubular cuff means 12 and the second pouch 4.

The tubular cuff means 12 has gusset means 14 built into it along the length of the cuff means 12 and is in substantial linear alignment with first pouch 6. Closure means 16 is affixed to gusset means 14 which is capable of taking up slack in the gusset means 14 to bring said cuff means 12 into a snug fitting relationship with the forearm of a wearer of the mitten when said closure means is actuated in a closed position. When said closure means 16 is opened, it permits the gusset means 14 to open, facilitating donning and removal of the mitten. Liquid diversion means 18 is provided on the cuff means 12 to direct the flow of liquids away from a wearer of the scouring mitten 2 of my invention.

Figure 2:
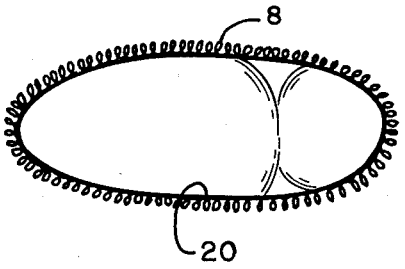
FIG. 2 is a section view along 2—2 of FIG. 1.

The first pouch 6 and second pouch 4 portions of the mitten are made of an inner stretchable waterproof layer 20 (see FIG. 2) and an outer layer 8 of an abrasive material. Said outer layer 8 is intrinsically bonded to said inner layer 20. Said outer layer 8 extends over the entire outer surface of the inner layer up to the wrist portion of the mitten which is shown in FIG. 1 as broken line 10. The outer layer 8 can be composed of any abrasive material which can be bonded to the inner layer 20 to provide an abrasive surface thereon, such as sand, bits of plastic and the like.

In the preferred embodiment of my invention, I utilize helical coils of plastic having a suitable coil diameter wound around the inner layer 20 of the scouring mitten 2 substantially perpendicular to the axis of the mitten wherein said coils are tangentially bonded on one side of the coils to the outer surface of the inner layer 20 of the mitten 2. Such coils not only provide an excellent scouring surface when the mitten is used, but permit sufficient stretchability of that portion of the mitten covered with the coils so that a single size mitten can be used to snugly fit many different hand sizes. Such a placement of the coils permits the glove to stretch linearly along its axis by permitting the rows of coils to move apart from each other and further permits the individual coils to expand when the inner lining is stretched transversely with respect to the axis of the scouring mitten 2. Similar beneficial results can be achieved when particulate abrasive matter and/or semi-rigid pieces of plastic filaments of suitable diameter are bonded to the inner surface 20 of the mitten 2 to provide scouring means 8.

The inner layer 20 and tubular cuff means 12 can be made of the same material and in the preferred embodiment of my invention are made of the same material by simply a one-step moulding operation. The gusset means 14 and liquid diversion means 18 are also moulded into the glove during that operation, thus permitting great economic benefit and efficiency of manufacture during fabrication.

The outer layer 8 is thereafter bonded onto the scouring mitten 2 in a second operation. The closure means 16 can be any conventional closure means currently available, such as those found on currently available self-sealing sandwich bags, snap-type buttons, zippers and the like. In the preferred embodiment of my invention, I use a Velcro-brand type closure means which is composed of synthetic materials which releasably adhere when pressed together. The closure means is composed of two pieces of a Velcro fabric, a first piece 30 mounted on the cuff means 12 on one side of the gusset means 14 and the second co-mating piece 32 of Velcro fabric is mounted on the cuff means 12 on the other side of the gusset means 14 and closure is accomplished by bringing the two mating surfaces into intimate contact with each other.

In another embodiment of my invention I utilize a zipper closure means which is composed of individual co-mating helical coils mounted on each side of the gusset means 14 and is actuated simply by putting pressure on the device which causes the two helical coils to become immeshed with each other and causes cuff means 12 to come into snug relationship with the forearm of a wearer of the mitten, preventing liquids from entering the inside of the mitten.

Either of such type closure permits one-handed actuation of the closure means 16. Opening of the closure means is easily achieved by applying sufficient pressure to the closure means 16 starting at the end of the closure means 16 which is located at the end of the scouring mitten 2 adjacent opening 22. Closure of the helical coil zipper type closure means 16 is achieved by applying a downward pressure on both sides of the closure means starting at that portion of the closure means which is located nearest the second pouch means and thereafter running said pressure linearly along the length of the closure means.

A particularly novel and beneficial feature of my invention is the fact that the gusset means 14 and the first pouch means 6 for the thumb are aligned with each other, permits, among other things, the scouring mitten to be worn on either the right or left hand of a wearer and further ensures that the gusset means 14 is always on the proper side of the forearm to facilitate actuation of the closure means 16.

The water diversion means 18 can be simply a circumferential beading around the outer surface of the cuff means 12 located at any point on the cuff means 12. In the preferred embodiment of my invention, the lip of the cuff means 12 located at the opening 20 of the scouring mitten 2 is made of a thickened portion and is flared backwards toward the second pouch 4 and outwards from the cuff means 12 to ensure both a proper means for diverting the flow of any liquids along the scouring mitten 2 away from the wearer and to give additional strength to the scouring mitten 2 to prevent tearing of the cuff means.

In the scouring mitten 2 of FIG. 1 a Velcro brand type closure means is shown wherein a strap means 36 is bonded to the cuff means 12 on one side of gusset means 14, said strap means having tab means 34 for pulling the strap to cause gusset means 14 to contract enabling one of the Velcro brand type closure means 32 mounted on said strap means 36 to be placed in contact with a second Velcro brand type closure means 30 which is mounted directly on said cuff means 12 to permit releasable locking of the strap means 36 onto cuff means 12.

Because of the close fitting characteristic of the scouring mitten of my invention, users thereof are able to wear a scouring mitten on each hand and firmly and securely hold the items to be scoured during the scouring thereof. The ability to use either hand to scour with greatly increased efficiency so that scouring operations can be performed on items such as large pots and the like is another advantage of my invention.

Because my novel mittens can be worn on either hand, users thereof have the distinct advantage of having to purchase only one mitten to replace individual mittens as they are torn or otherwise damaged. When users of my novel mittens use one on each hand they are enabled to scour large objects without having to turn them over in the sink, a feature which prevents slopping of wash water onto floors.

Now, having described the invention and the manner and process of making and using it, in full, clear, concise and exact terms so that one skilled in the art can make and use same, and having set forth the best mode contemplated by the inventor of carrying out this invention in accordance with the statute, and aware that many variations of the invention can be practiced without departing from the spirit and the teachings of this specification, my invention should not be narrowly limited to the embodiment herein disclosed and illustrated, but should be construed broadly, according to the appended claims.

What is claimed is:

1. A waterproof stretchable scouring mitten comprising:

hand covering means having a first pouch for enveloping a thumb and a second pouch for enveloping the remainder of the hand having a generally planar configuration and extending along an axis and a wrist opening to provide means for insertion and removal of a hand, said first pouch opening into and extending radially from said axis in substantial planar alignment with said axis, said hand covering means being composed of a waterproof stretchable first layer and a second layer of scouring material intimately bonded to and covering the outer surface of said first layer;

tubular shaped stretchable waterproof cuff means extending from and connected with the said wrist opening, said cuff means having waterproof gusset means along the linear axis of the cuff means located normal to the plane of the said first pouch means to facilitate ingress and egress of a hand into the mitten through the cuff;

closure means affixed to said gusset means to bring at least a circumferential portion of said cuff means to a snug fitting relationship with a portion of the forearm of a wearer of the mitten;

and, liquid flow diversion means circumferentially mounted on said cuff means to direct the flow of liquids towards said hand covering means.

2. The scouring mitten of claim 1 wherein said scouring material is comprised of helical coils of pliable plastic tangentially bonded to and covering the outer surface of said first layer.

3. The scouring mitten of claim 2 wherein said cuff means and said first layer are made of pliable plastic material.

4. The scouring mitten of claim 3 wherein said liquid flow diversion means is located along the edge of said cuff means distal to the wrist end of said cuff means.

5. The scouring mitten of claim 4 wherein said closure means is a Velcro brand type closure means.

* * * * *